US005624029A

United States Patent [19]

Shih

[11] Patent Number: 5,624,029

[45] Date of Patent: Apr. 29, 1997

[54] TOOL BOX WITH A LIGHTING APPARATUS

[76] Inventor: Yi L. Shih, P.O. Box 82-144, Taipei, Taiwan

[21] Appl. No.: 666,629

[22] Filed: Jun. 18, 1996

[51] Int. Cl.[6] ..... B65D 85/28

[52] U.S. Cl. ..... 206/372; 362/154; 362/191; 43/17.5

[58] Field of Search ..... 206/372, 373, 206/234; 362/190, 191, 154, 156; 43/17.5

[56] References Cited

U.S. PATENT DOCUMENTS

| | | | |
|---|---|---|---|
| 690,753 | 1/1902 | McCormick | 362/156 |
| 2,290,419 | 7/1942 | Dunn | 362/156 |
| 5,134,558 | 7/1992 | Williams et al. | 362/190 |
| 5,143,440 | 9/1992 | Trampota | 362/154 |
| 5,459,648 | 10/1995 | Courtney | 206/373 |

*Primary Examiner*—Paul T. Sewell
*Assistant Examiner*—Nhan T. Lam
*Attorney, Agent, or Firm*—Alfred Lei

[57] ABSTRACT

A tool box with a lighting apparatus including a casing formed with two perforations at an end thereof and a circular opening between the two perforations, a lighting apparatus including a holder and a cover, a conical reflector being fitted within a tubular neck of the holder, a bulb threadedly engaged with a socket of the holder, an annular member threadedly engaged with the tubular neck, and a lens arranged on the conical reflector and kept in place by engaging a locking member with the tubular neck, whereby the tool box can give light as desired thereby offering much convenience in use.

1 Claim, 4 Drawing Sheets

TOOL BOX WITH A LIGHTING APPARATUS

BACKGROUND OF THE INVENTION

1. Field of the Invention

This invention is related to a tool box and in particular to one which is provided with an apparatus for giving light.

2. Description of the Prior Art

It has been found that the conventional tool box is simply a container for receiving tools. Hence, for those who needs to carry a tool box to pass through a dark place or the like for maintenance, it is necessary for them to carry a tool box in one hand and a flashlight in the other. Hence, this makes it impossible for them to have a free hand to find necessary support in case of danger thereby making it unfit for practical use.

Therefore, it is an object of the present invention to provide a tool box with a lighting apparatus which can obviate and mitigate the above-mentioned drawbacks.

SUMMARY OF THE INVENTION

This invention relates to a tool box with an apparatus for giving light.

It is the primary object of the present invention to provide a tool box which can give light as desired.

It is another object of the present invention to provide a tool box with a lighting apparatus which is fit for practical use.

It is still another object of the present invention to provide a tool box with a lighting apparatus which is simple in construction.

It is still another object of the present invention to provide a tool box with a lighting apparatus which is convenient to use.

It is a further object of the present invention to provide a tool box with a lighting apparatus which is easy to manufacture.

Other objects of the invention will in part be obvious and in part hereinafter pointed out.

The invention accordingly consists of features of constructions and method, combination of elements, arrangement of parts and steps of the method which will be exemplified in the constructions and method hereinafter disclosed, the scope of the application of which will be indicated in the claims following.

DETAILED DESCRIPTION OF THE PREFERRED EMBODIMENT

Figure 1:
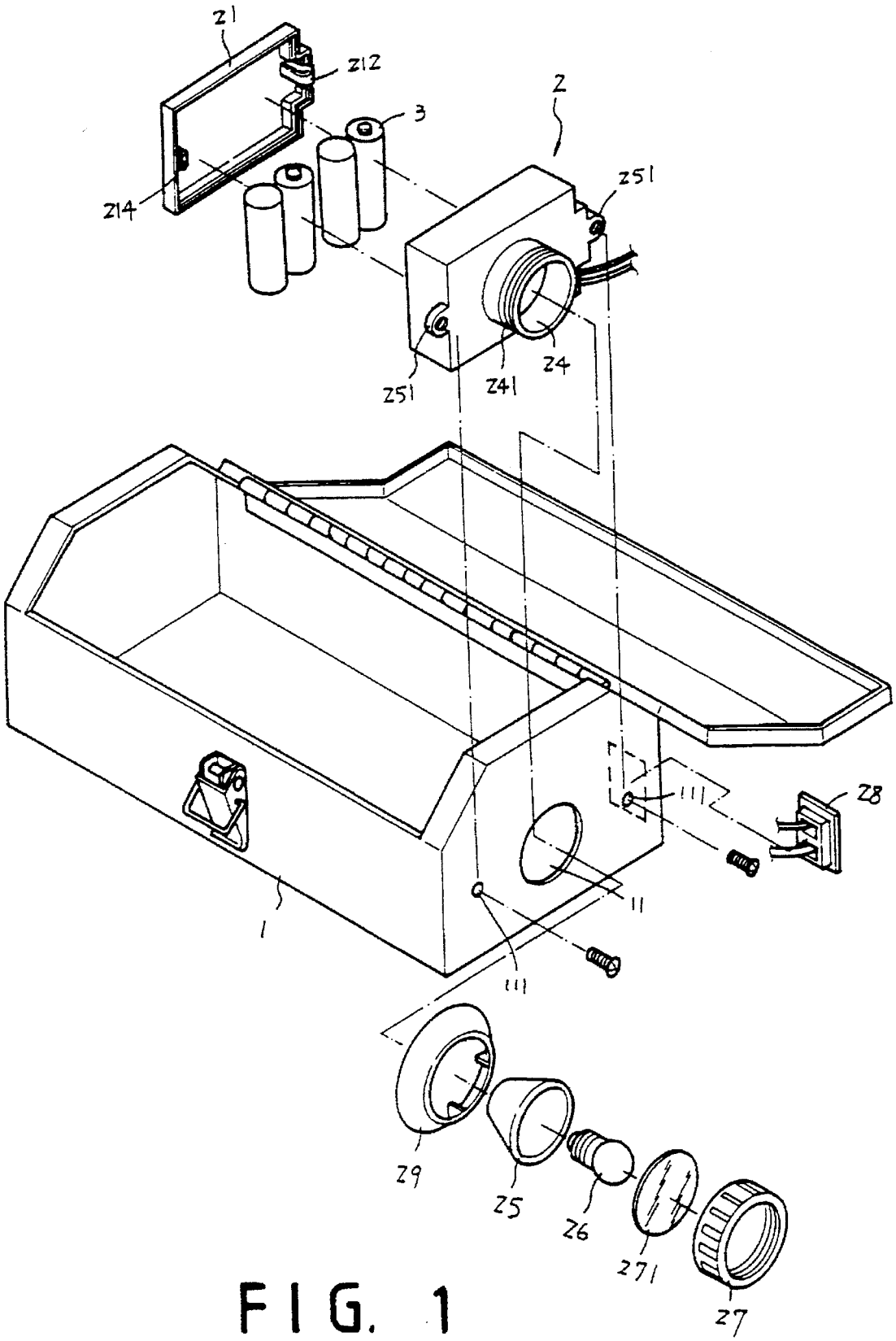
FIG. 1 is an exploded view of the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 2:
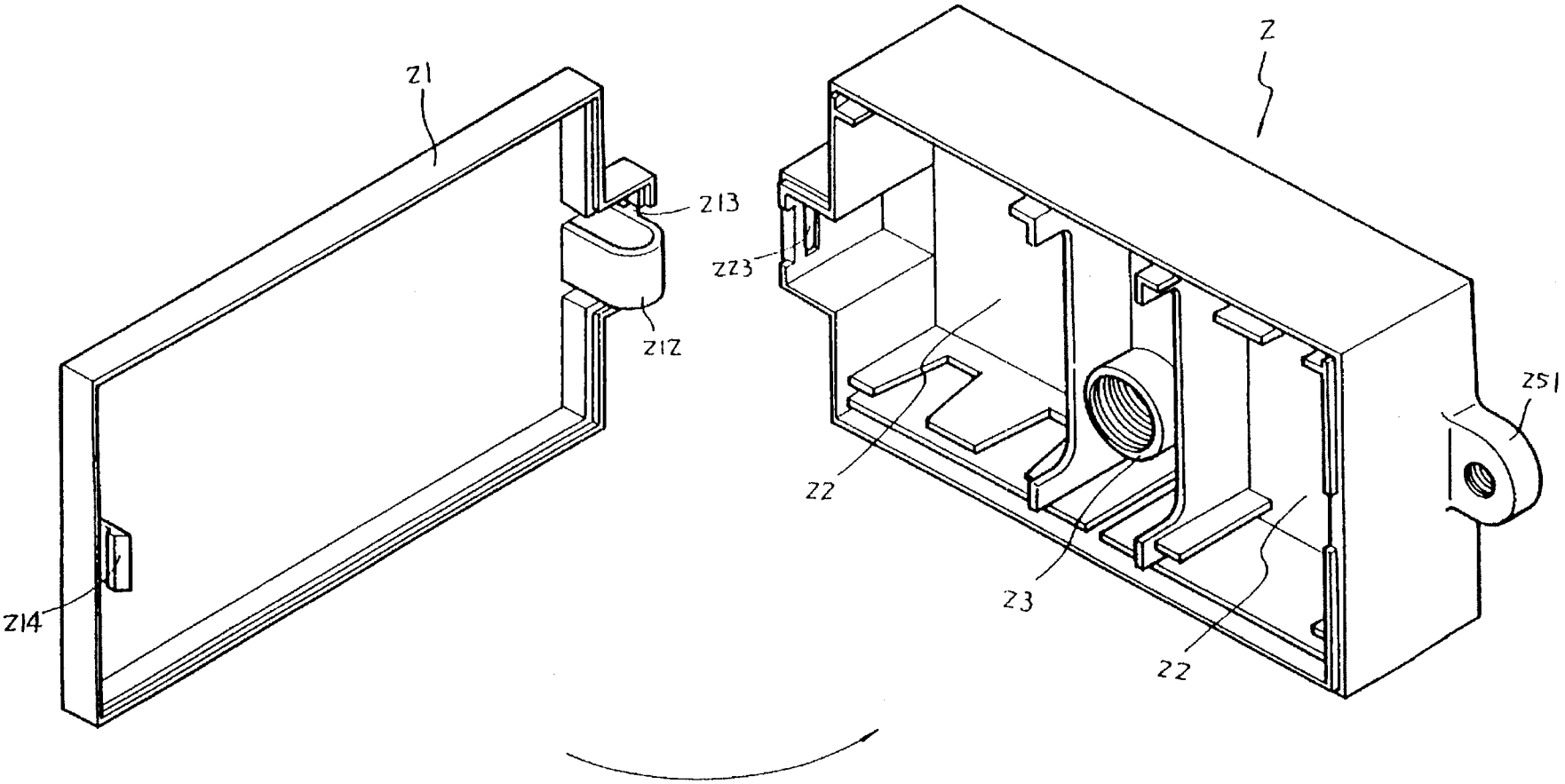
FIG. 2 illustrates how to engage the cover with the holder.
Figure 3:
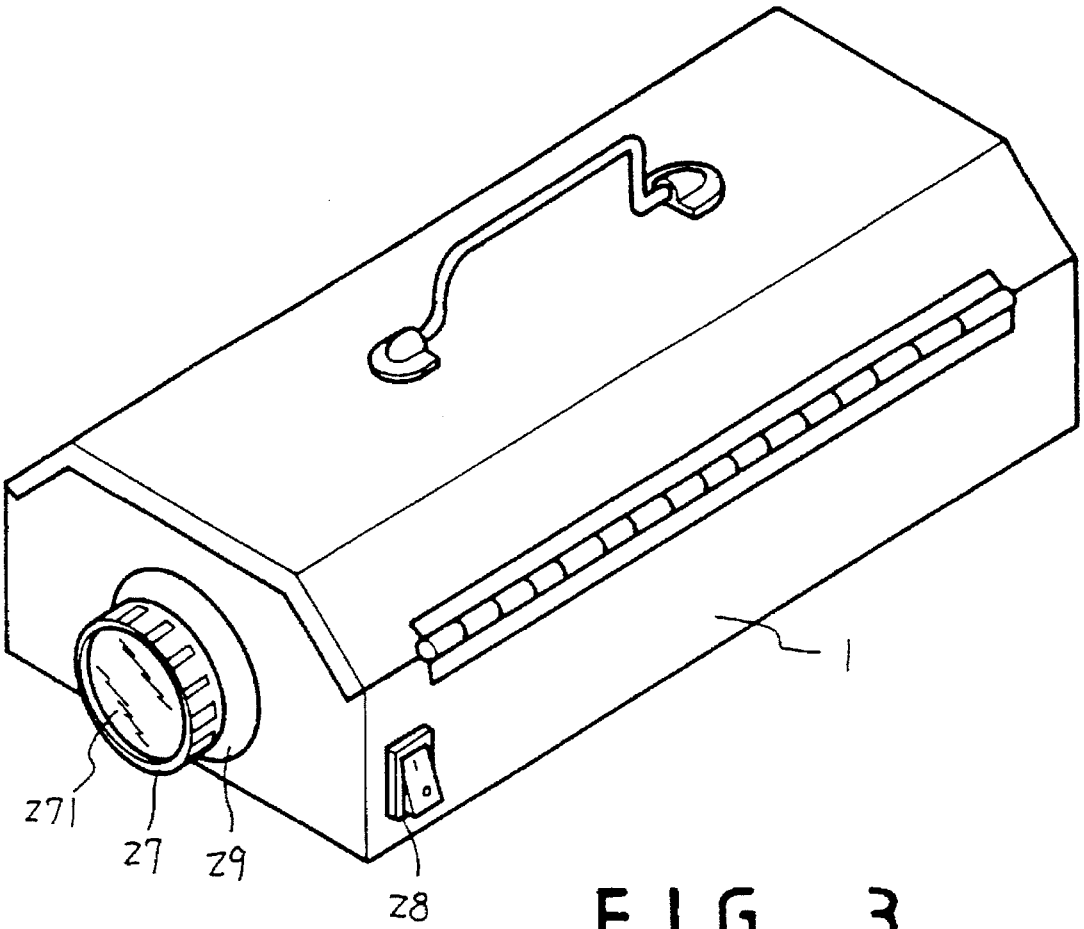
FIG. 3 is a perspective view of the present invention.

With reference to the drawings and in particular to FIGS. 1, 2 and 3 thereof, the tool box with a lighting apparatus according to the present invention mainly comprises a casing 1 and a lighting apparatus 2.

The casing 1 is formed with two perforations 111 at an end thereof and a circular opening 11 between the two perforations 111. The lighting apparatus 2 is mounted within the casing 1 and includes a holder 2 and a cover 21.

The holder 2 is a rectangular member formed at the central portion of its rear side with an internally threaded electrical socket 23 and an externally threaded tubular neck 24 at the central portion of its outer side. The holder 2 is provided with two lugs 251 at two opposite sides thereof. The holder 2 is fixedly mounted within the casing 1 by screws (see FIG. 4) extending through the lugs 251 of the holder 2 and the perforations 111 of the casing 1, with the tubular neck 24 extending out the circular opening 11 of the casing 1. The tubular neck 24 is larger than the socket 23 in diameter and coaxial with the socket 23 (see FIG. 4). A conical reflector 25 is fitted within the tubular neck 24. A bulb 26 is threadedly engaged with the socket 23. An annular member 29 is engaged with the threaded portion 241 of the tubular neck 24 for preventing water from flowing into the casing 1 through the circular opening 11. A lens 271 is arranged on the conical reflector 25 and kept in place by engaging a locking member 27 with the threaded portion of the tubular neck 24. The rear side of the holder 2 is formed with a pair of battery chambers 22 for receiving batteries 3. The holder 2 has two recesses 222 and 223 at two opposite sides (see FIG. 4). A switch 28 is mounted on one side of the casing 1 and electrically connected with the socket 23 and the battery chamber 22. The electrical connection between the switch 28, the electrical socket 23 and the battery chamber 22 are well known in the art and not considered a part of the invention.

Figure 4:
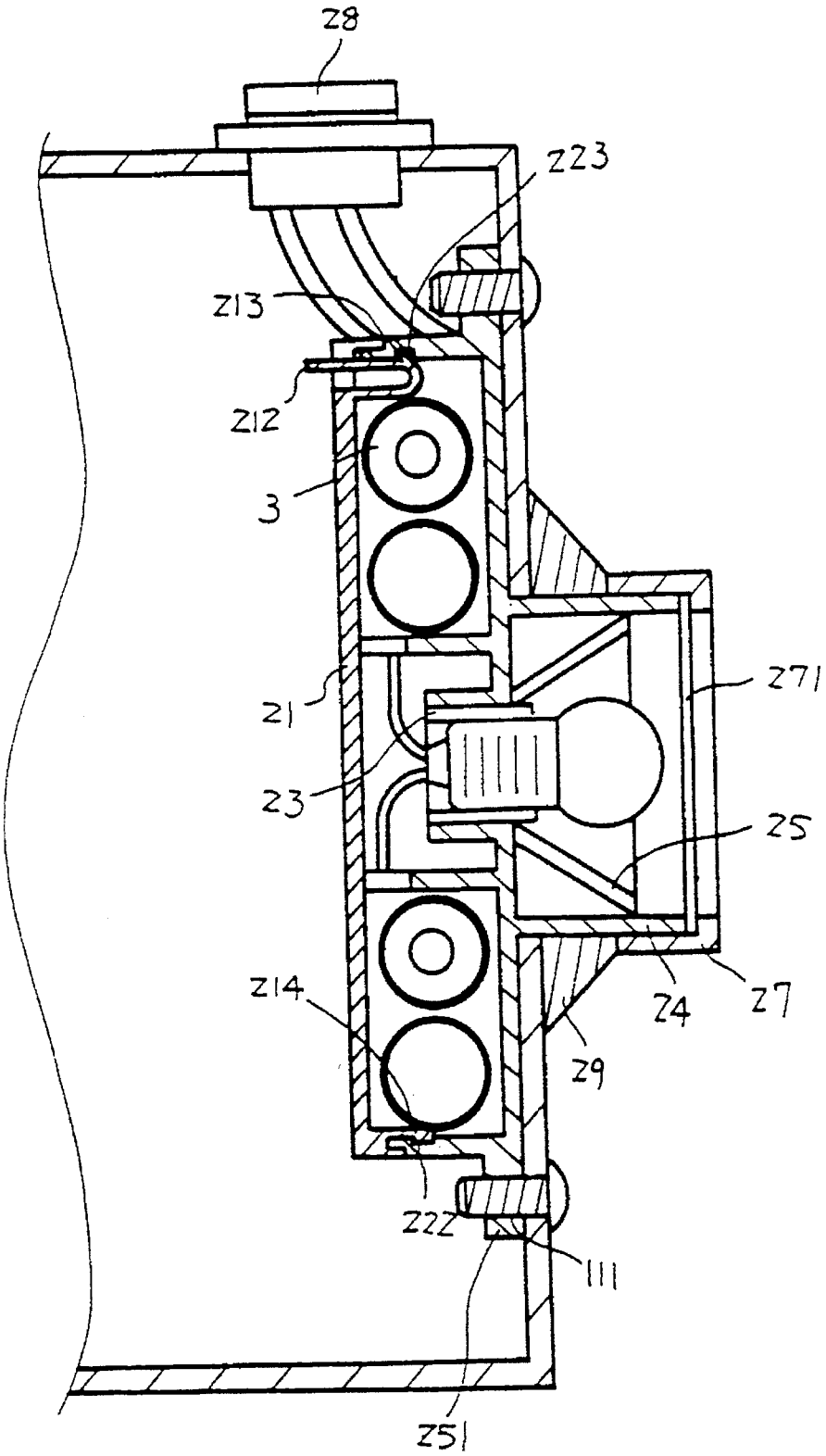
FIG. 4 is sectional view illustrating the structure of the lighting apparatus.

The cover 21 is rectangular in shape, which is provided at one end with a hook-like member 214 adapted to engage with the recess 222 of the holder 2 and at the other end with a U-shaped member 212 having a protuberance 213 adapted to engage with the recess 223 of the holder 2 (see FIGS. 2 and 4).

The invention is naturally not limited in any sense to the particular features specified in the forgoing or to the details of the particular embodiment which has been chosen in order to illustrate the invention. Consideration can be given to all kinds of variants of particular embodiment which has been described by way of example and of its constituent elements without thereby departing from the scope of the invention. This invention accordingly includes all the means constituting technical equivalents of the means described as well as their combinations.

I claim:

1. A tool box with a lighting apparatus comprising:

a casing formed with two perforations at an end thereof and a circular opening between said two perforations;

a lighting apparatus including a holder and a cover, said holder being a rectangular member formed at a central portion of a first side thereof with an internally threaded socket and an externally threaded tubular neck at a central portion of a second side thereof, said holder being mounted within said casing with said tubular neck extending out of said circular opening, said tubular neck being larger than said socket in diameter and coaxial with said socket, said holder having two recesses at two opposite end walls thereof, said cover being rectangular in shape provided at one end with a hook-like member adapted to engage with one of said recesses of said holder and at another end with a U-shaped member having a protuberance adapted to engage with another one of said recesses of said holder;

a conical reflector being fitted within said tubular neck;

a bulb threadedly engaged with said socket;

an annular member threadedly engaged with said tubular neck and a lens arranged on said conical reflector and kept in place by engaging a locking member with said tubular neck, said first side of said holder being formed with a pair of battery chambers.

* * * * *